US007530246B2

(12) United States Patent
Yang

(10) Patent No.: US 7,530,246 B2
(45) Date of Patent: May 12, 2009

(54) WAFER-TYPE TUMBLER CYLINDER AND KEY

(76) Inventor: Cheng-Ju Yang, No. 8, Lane 55, Sec. 2 Guiyang St., Taipei (TW) 108

( * ) Notice: Subject to any disclaimer, the term of this patent is extended or adjusted under 35 U.S.C. 154(b) by 0 days.

(21) Appl. No.: 11/804,659

(22) Filed: May 21, 2007

(65) Prior Publication Data

US 2008/0289378 A1 Nov. 27, 2008

(51) Int. Cl.
*E05B 9/04* (2006.01)
*E05B 29/06* (2006.01)

(52) U.S. Cl. ..... 70/492; 70/373; 70/375

(58) Field of Classification Search ..... 70/1.5, 70/417, 492–495, 375, 373, 377, 392, DIG. 1
See application file for complete search history.

(56) References Cited

U.S. PATENT DOCUMENTS

| | | | | | |
|---|---|---|---|---|---|
| 1,524,862 | A * | 2/1925 | Hight | 70/375 |
| 2,155,440 | A * | 4/1939 | Olson | 70/358 |
| 2,182,809 | A * | 12/1939 | Johnstone | 70/492 |
| 3,578,371 | A * | 5/1971 | Keller | 70/492 |
| 3,702,553 | A * | 11/1972 | Nolin | 70/375 |
| 3,863,476 | A * | 2/1975 | Patriquin | 70/419 |
| 3,974,671 | A * | 8/1976 | Rossetti | 70/375 |
| 4,472,953 | A * | 9/1984 | Gater | 70/373 |
| 5,671,623 | A * | 9/1997 | Hsu | 70/375 |
| 6,185,966 | B1 * | 2/2001 | Chen | 70/366 |
| 6,666,057 | B1 * | 12/2003 | Huang | 70/375 |
| 6,668,607 | B1 * | 12/2003 | Huang | 70/375 |
| 7,007,528 | B2 * | 3/2006 | Chong et al. | 70/492 |
| 2005/0016234 | A1 * | 1/2005 | Strader et al. | 70/492 |
| 2005/0172687 | A1 * | 8/2005 | Segien et al. | 70/493 |
| 2006/0117822 | A1 * | 6/2006 | Boesel et al. | 70/495 |

* cited by examiner

*Primary Examiner*—Lloyd A Gall

(57) ABSTRACT

A wafer-type tumbler cylinder comprises a sleeve, a cylinder, some wafers and some springs. A shaft of the cylinder includes a first and a second semicircular columnar body. The first semicircular columnar body includes a front flange, a rear drive section and a U-shaped indentation at the inner lateral surface that provides for insertion into the second semicircular columnar body. On the first and second semicircular columnar bodies, one or more slots are disposed to fasten with the wafers. A relatively wider rectangular notch is disposed between the inner sides of every two slots, which are respectively installed with a wafer; only one spring is positioned in the wider rectangular notch, thereby serving as a shared spring for every two wafers. The material cost of a spring is saved; besides, it's able to prevent from prying effectively because a burglar cannot pry two wafers supported by a shared spring.

4 Claims, 10 Drawing Sheets

WAFER-TYPE TUMBLER CYLINDER AND KEY

BACKGROUND OF THE INVENTION

1) Field of the Invention

The invention relates to a wafer-type tumbler cylinder, the cylinder shaft of which facilitates the placement of the wafers and springs and, furthermore, one spring is positioned in a relatively wider rectangular notch, thereby serving as a shared spring for every two wafers. The amount of spring is reduced by half and it's able to prevent from prying or unlocking. Moreover, it's more convenient for lock makers to make and assemble various cylinders in different shapes or different length.

2) Description of the Prior Art

Conventional wafer-type tumblers, as shown in FIG. 14, are typically comprised of a sleeve 1*a*, a cylinder 2*a*, and a plurality of wafers 3*a* and their springs 4*a*. The sleeve 1*a* consists of a sleeve body 10 having a bore 11 extending through it lengthwise, a minimum of one lengthwise slot 12 disposed along the inside of the bore 11, and a bearing edge 13 at the leading end of the bore 11. As shown in FIG. 15, the cylinder 2*a* has a keyway 21 through the center and, furthermore, a flange 22 and a drive section 23 at the front and rear ends, with a shaft 20 movably installed in the bore 11 of the sleeve 1*a*; the shaft 20 has disposed one or more diametrically oriented, rectangular through-holes 24 and, furthermore, at the two sides of each rectangular through-hole 24 is a C-shaped recess 25 and a horizontally oriented U-shaped recess 26 (as shown in FIGS. 16 and 17), for the installation of one or more wafer 3*a* and spring 4*a* sets. The cylinder 2*a*, after the installation of the wafers 3*a* and their springs 4*a*, is first fitted into the bore 11 of the sleeve 1*a* and, furthermore, such that the one end of each wafer 3*a* is subjected to the elastic force of its spring 4*a*, and then postured against and inserted into the slot 12 inside the bore 11, thereby obstructing the clockwise and counter-clockwise rotation of the cylinder 2*a* situated in the bore 11; at the same time, the flange 22 at the front end of the cylinder 2*a* is seated on the bearing edge 13 at the leading end of the bore 11 in order to inset securely the bore 11; additionally, the drive section 23 at the rear end of the cylinder 2*a* is mounted with a lock tool or electric driver so as to check whether the tumbler is locked or electrified.

Because each wafer 3*a* of the conventional wafer-type tumbler, in addition to a window 31 in the middle thereof, has an opposing spring tab 32 and a locating tab 34; when the wafer 3*a* is inserted into each rectangular through-hole 24 on the shaft 20 of the cylinder 2*a*, it is first necessary to install a spring 4*a* into the C-shaped recess 25 at one side of the rectangular through-hole 24, following which the wafer 3*a* is then inserted into the rectangular through-hole 24; but during the installation, since the wafer body 30 of the wafer 3*a* has the spring tab 32, its insertion occurs without any resistance along the C-shaped recess 25; however, the locating tab 34, disposed in the other side of the wafer body 30, must similarly undergo insertion through the C-shaped recess 25 along the rectangular through-hole 24, and, as a result, friction occurs along the interior wall of the rectangular through-hole 24 at the lateral extent of the C-shaped recess 25, and only after this does the wafer body 30 reach into the horizontally oriented U-shaped recess 26, where it becomes nested onto the bottom of the horizontally oriented U-shaped recess 26 (as shown in FIGS. 16 and 17), and also only then is the cylinder 2*a* installed in the bore 11 of the sleeve 1*a*, which completes the assembly of one wafer-type tumbler mechanism. As such, during the insertion of each wafer 3*a* into the rectangular through-hole 24 on the shaft 20, the operation is difficult and adversely affects the production process. After each wafer 3*a* has been inserted into the rectangular through-hole 24, the locating tab 34 on the wafer body 30 is nested onto the bottom of the horizontally oriented U-shaped recesses 26; however, the height of the locating tab 34 is quite limited and, furthermore, the locating tab 34 is subjected to the outwardly exerted elastic force of the spring 4*a*, the wafer 3*a* is often ejected out of the rectangular through-hole 24. Such situation results in a troublesome and inconvenient assembly operation as the cylinder 2*a* is inserted into the bore 11 of the sleeve 1*a*, which likewise adversely affects the production process.

Moreover, based on the locking and unlocking structure of the conventional wafer-type tumbler, it depends entirely on the installation of the shaft 20 on the cylinder 2*a* with a plurality of wafers 3*a*; hence, as indicated in FIG. 15, the rectangular keyway 21 must be disposed through the center of the shaft 20 to facilitate insertion of the serrated blade 51 on the key 5*a* (as shown in FIG. 19), which causes each wafer 3*a* extending into the end of the slot 12 in the bore 11 to fully react within the outer diameter of the shaft 20, thereby achieving the objective of locking or unlocking. Since the cylinder 2*a* of the conventional wafer-type tumbler is typically made of aluminum-zinc alloy material in an integrated molding process, and the keyway 21 disposed through the center of the shaft 20 also penetrates the internal section of the shaft 20; as a result, it is not possible to mold a corrugated keyway having a narrow width. It's only possible to mold a keyway with a width of 1.5 mm or more, and as indicated in FIG. 14, the shape of the keyhole 211 only can be formed as reverse Z-shaped or other similar contour, which has a triangular projecting element 212 at the two lateral inner sides of the keyhole 211 respectively (one triangular projecting element is concealed by the flange 22, so it's not viewable); the keyway 21 along the internal section of the shaft 20 not only is formed as relatively wide rectangular shape, but also has disposed at most one lengthwise triangular projecting element 212 at one side of the keyway 21, as indicated in FIGS. 15 and 18. As a result, the prior art is easily broken by thieves and pried or unlocked by burglars.

Due to the shape of the keyway 21 and its keyhole 211 on the shaft 20 of the cylinder 2*a* in the conventional wafer-type tumbler, the design of which is formed as relatively wide rectangular and reverse Z-shaped contour, and furthermore, the two triangular projecting elements 212 are disposed in opposing position and at close distance along the two lateral inner sides of the keyhole 211; therefore, the serrated blade 51 of the key 5*a* must be fabricated of a thicker metal plate. Even though the whole key 5*a* may be formed by punching the metal plate, the serrated blade 51 (as indicated in FIGS. 19 and 20) must undergo milling or planing process to form as reverse Z-shaped section by means of a miller or planer, and it also has to undergo cutting or milling process to make a lengthwise V-shaped groove 511 at each of the lateral sides. Therefore, in terms of production, the process is extremely inconvenient and, furthermore, both time and labor consuming.

In view of the serrated blade 51 of the conventional wafer-type tumbler cylinder, there are such inconveniences and shortcomings during the process of production and assembly; such production cost is greater and not cost-effective and also the theftproof capability of the prior art still remained deficient, so the inventor of the invention herein conducted research which culminated in the improved wafer-type tumbler cylinder of the present invention.

SUMMARY OF THE INVENTION

The objective of the invention herein is to provide a wafer-type tumbler cylinder having a spring positioned in a relatively wider rectangular notch to serve as a shared spring for every two wafers. The amount of spring is reduced by half and the theftproof capability is much improved.

Another objective of the invention herein is to provide a wafer-type tumbler cylinder that is easily made and assembled into different shapes or different length of cylinder. It is cost-effective for lock makers to save the production cost of molds.

To achieve the first objective of the invention herein, the shaft of the cylinder consists of a first and a second semicircular columnar body that are insertionally conjoined into an integration, and furthermore, respectively disposed at the front and rear ends of the first semicircular columnar body are a flange and a drive section; although, on the inner lateral surfaces of the first and second semicircular columnar bodies, one or more rightward and leftward U-shaped slots are disposed; only disposed in every two rightward or leftward U-shaped slots is a relatively wider rectangular notch. As a wafer is installed in each of the two rightward (or leftward) U-shaped slots, a spring is positioned in the relatively wider rectangular notch to serve as a shared spring for every two wafers. The material cost of a spring is saved; besides, it's able to prevent from prying effectively because a burglar can not pry two wafers supported by a shared spring.

Another embodiment of shaft of the cylinder consists of a first and a second semicircular columnar bodies with identical shape and dimension, which are combined into an integration; furthermore, a semicircular tenon (or semi-rectangular or other shaped tenon) respectively disposed at the front and rear ends of each said semicircular columnar body enables, following the installation with a plurality of wafers and their springs, the respective fitting of a sleeve ring and a drive section onto the front and rear ends to thereby assemble one shaft. As such, it's convenient to produce and assemble different numbers of wafers into different length of shafts, and as different shapes of inner hole of the sleeve ring and the corresponding shape of cavity of the drive section are fitted thereon, it is quite convenient to manufacture longer or shorter shafts so as to assemble the wafer-type tumblers with different length or different shapes.

BRIEF DESCRIPTION OF THE DRAWINGS

FIGS. 5-1 is a cross-sectional drawing, as viewed from a perspective in FIG. 5, to show the adjacent wafer and its spring of the invention herein.

DETAILED DESCRIPTION OF THE PREFERRED EMBODIMENTS

Figure 1:
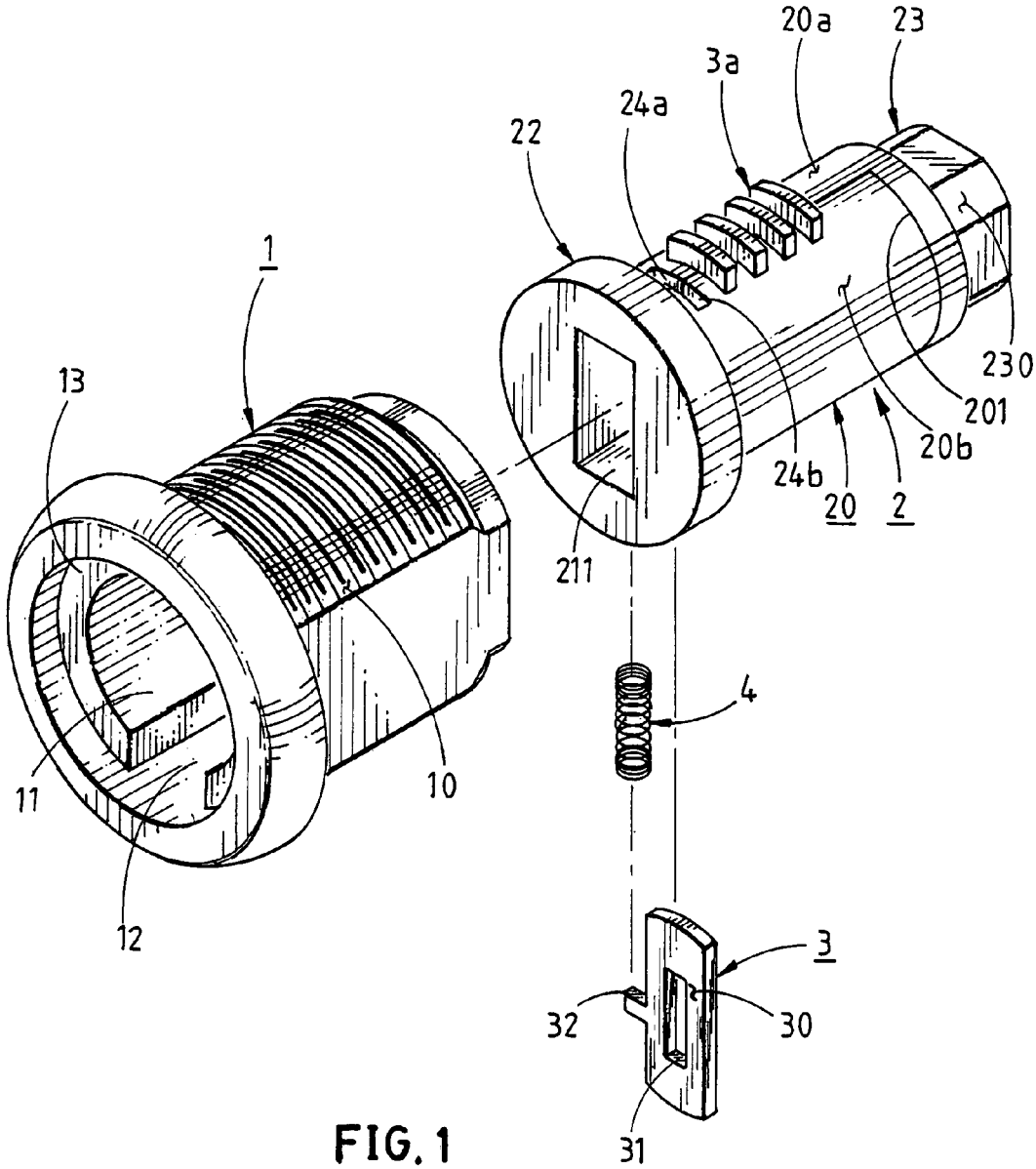
FIG. 1 is an exploded drawing of the wafer-type tumbler of the invention.
Figure 2:
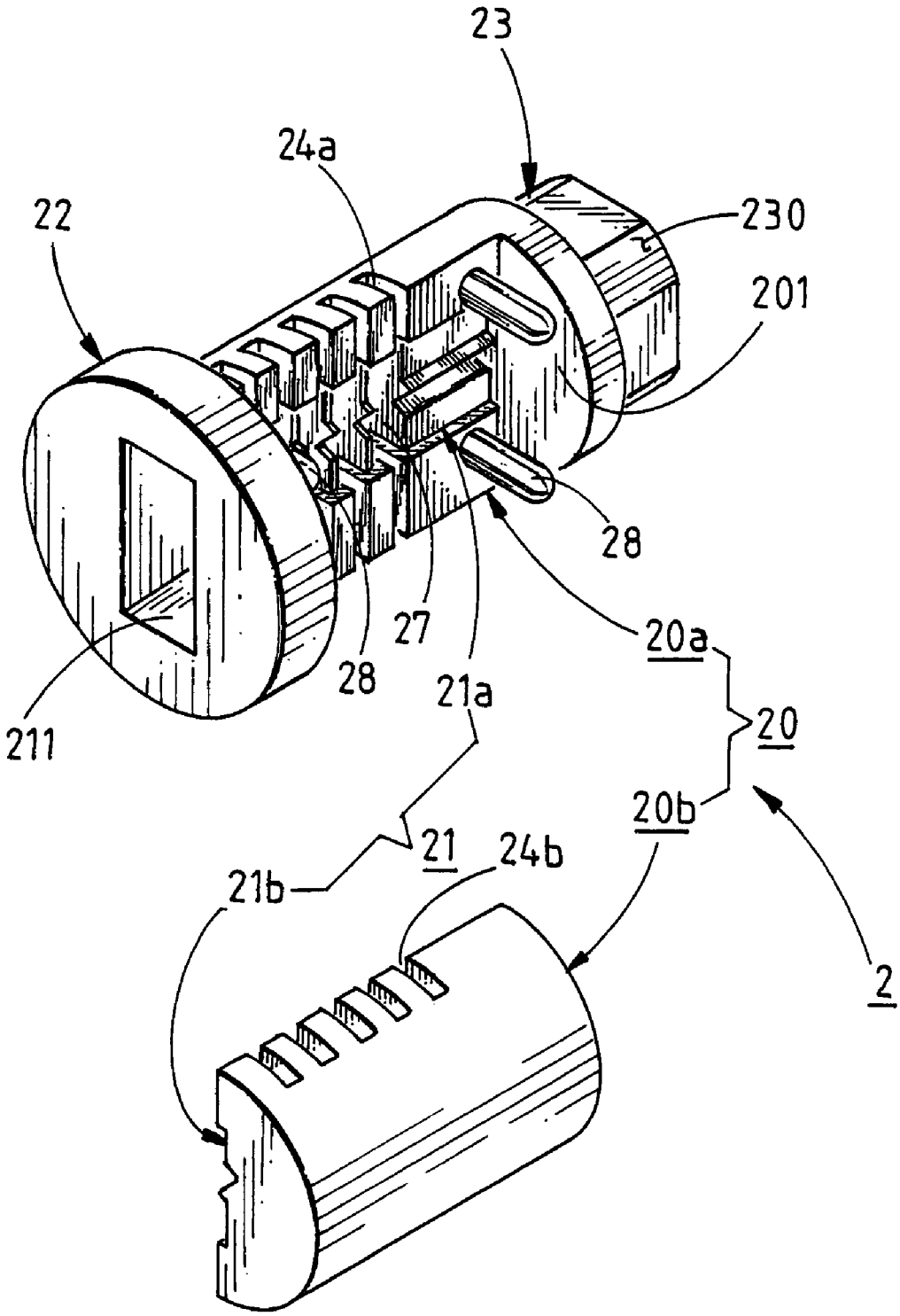
FIG. 2 is an exploded drawing of the wafer-type tumbler cylinder of the invention.
Figure 5:
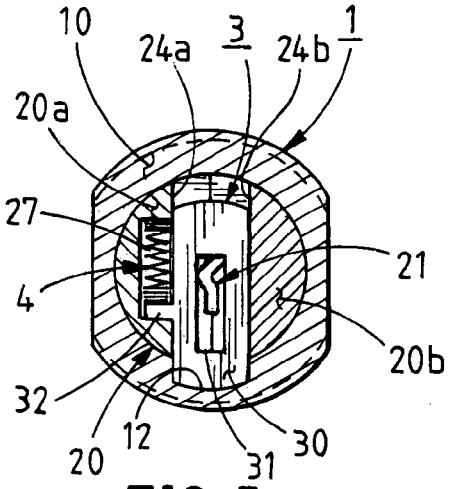
FIG. 5 is a cross-sectional view as the wafer-type tumbler is installed with one wafer and its spring.
Figures 1, 5:
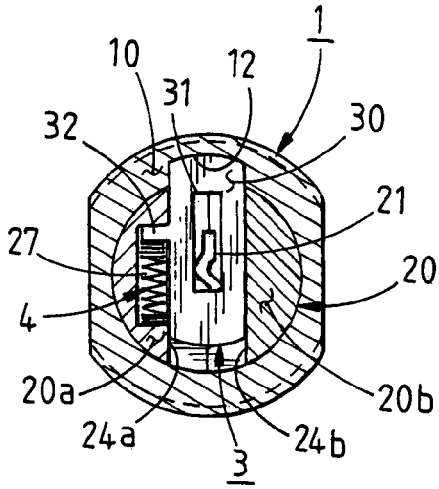

Referring to FIG. 1, the wafer-type tumbler of the invention herein, in common with the above-mentioned conventional wafer-type tumbler, is comprised of a sleeve 1, a cylinder 2, a plurality of wafers 3 and their springs 4; the structure of the sleeve 1 and the method for installing with the cylinder 2 are the same as those of said conventional wafer-type tumbler. There is no need to go into details. However, a shaft 20 of the cylinder 2, as shown in FIG. 2, consists of a first and a second semicircular columnar body 20*a* and 20*b* that are integrated with each other; furthermore, respectively disposed at the front and rear ends of the first semicircular columnar body 20*a* are a flange 22 and a drive section 23; at the inner lateral surface between said flange 22 and drive section 23 is a transversely U-shaped indentation 201, the length of which matches with the second semicircular columnar body 20*b* so as to complete the assembly of the shaft 20 on the cylinder 2 (as indicated in FIG. 1.) On the inner lateral surfaces of the first and the second semicircular columnar body 20*a* and 20*b*, one or more rightward U-shaped slots 24*a* and leftward U-shaped slots 24*b* are disposed for the installation of said wafers 3; however, only in each of the rightward U-shaped slots 24*a* on said first semicircular columnar body 20*a* is disposed a rectangular notch 27 matching the dimension of the spring 4, thereby facilitating the placement of each wafer 3 and its spring 4 into each said U-shaped slot 24*a* and said rectangular notch 27 on said first semicircular columnar body 20*a*, following which the second semicircular columnar body 20*b* is then fitted thereon for an integral unity; after that, the shaft 20 of said cylinder 2 is inserted into a shaft hole 11 in said sleeve 1 to assemble the wafer-type tumbler of the present invention, as illustrated in FIG. 5 as well as FIGS. 5-1.

Figure 3:
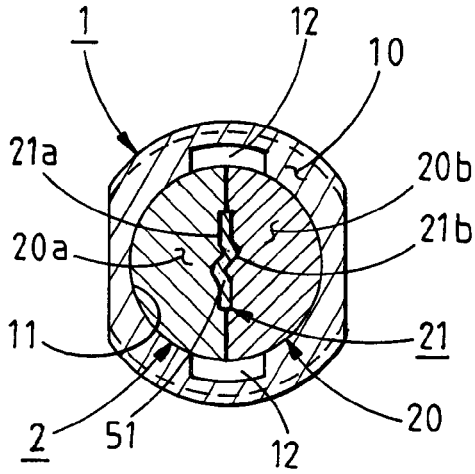
FIG. 3 is a cross-sectional view of the invention herein when the wafer-type tumbler is not installed with wafers and when the serrated blade of the key is inserted.
Figure 4:
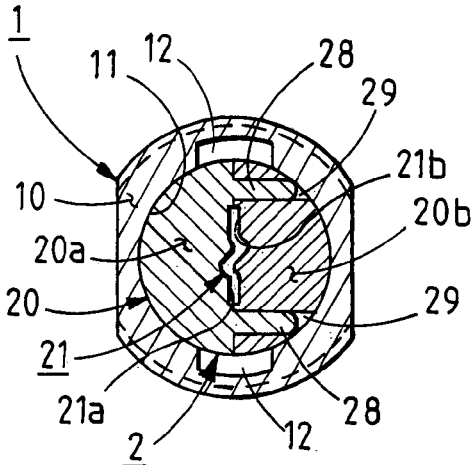
FIG. 4 is cross-sectional view of the invention herein when the wafer-type tumbler is interlocked.

When said first and second semicircular columnar body 20*a* and 20*b* are molded into shape, two half-keyways 21*a* and 21*b* are formed as corrugated contour in the center of the inner lateral surfaces thereof, furthermore, one or more posts 28 (as shown in FIG. 2) and holes 29 (which are concealed by the second semicircular columnar body 20*b*, so please refer to FIG. 4) are disposed at the front and rear ends of each said inner lateral surface. As such, the second semicircular columnar body 20*b*, via the insertion of said posts 28 through said holes 29, is correspondingly fixed with the first semicircular columnar body 20*a* into a unity so as to complete the assemblage of the cylinder 2, as indicated in FIGS. 1, 3 and 4; at the same time, along the common center of the first and second semicircular columnar body 20*a* and 20*b*, a keyway 21 (as shown in FIG. 4) is formed as corrugated contour, with a narrower width of 0.5 mm, thereby preventing theft by means of a metal sheet or other equivalent tool inserted for burglarizing.

Figure 7:
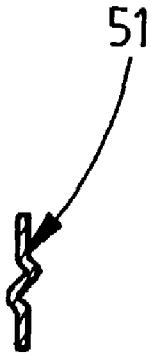
FIG. 7 is a cross-sectional drawing of the serrated blade of the wafer-type tumbler key.
Figure 6:
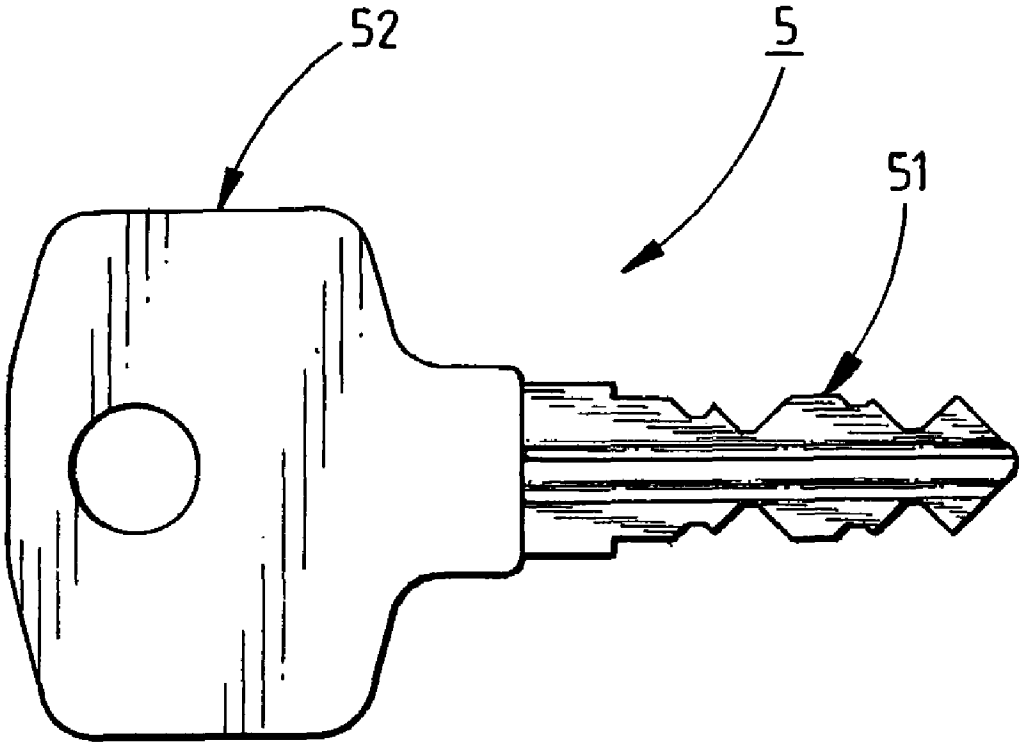
FIG. 6 is an orthographic drawing of the wafer-type tumbler key of the invention.

Since the keyway 21 disposed at the center of the cylinder 2 is approximately 0.5 mm in width and is fabricated as corrugated passage, a serrated blade 51 of a key 5 (as depicted in FIGS. 6 and 7) is produced by directly punching an approximately 0.5 mm or thinner metal plate, and a plastic grip 52 is coated onto the opposite end thereof, thereby facilitating the user holding the key for locking and unlocking the wafer-type tumbler; it is not necessary to mill and plane any lengthwise grooves nor other milling and planing processes. To facilitate the insertion of said very thin serrated blade 51 into the keyway 21 in the shaft 20 of the cylinder 2, it is then necessary, in the center of the flange 22 at the front end of said shaft 20, to dispose a rectangular, flared keyhole 211 that is in line with said keyway 21. As for the drive section 23 at the rear end of said shaft 20, in addition to the depiction shown in FIG. 1 and FIG. 2 wherein the drive section 23 is shaped as square or rectangular rod body 230, said drive section 23 may be shaped as threaded, circular, oblate, tubular or other shaped rod body (not shown in the drawings) to make the design of said drive section 23 match with a lock tool or electric driver, thereby enabling said drive section 23 to fasten with said lock tool or electric driver by means of screws or rivets.

Figure 14:
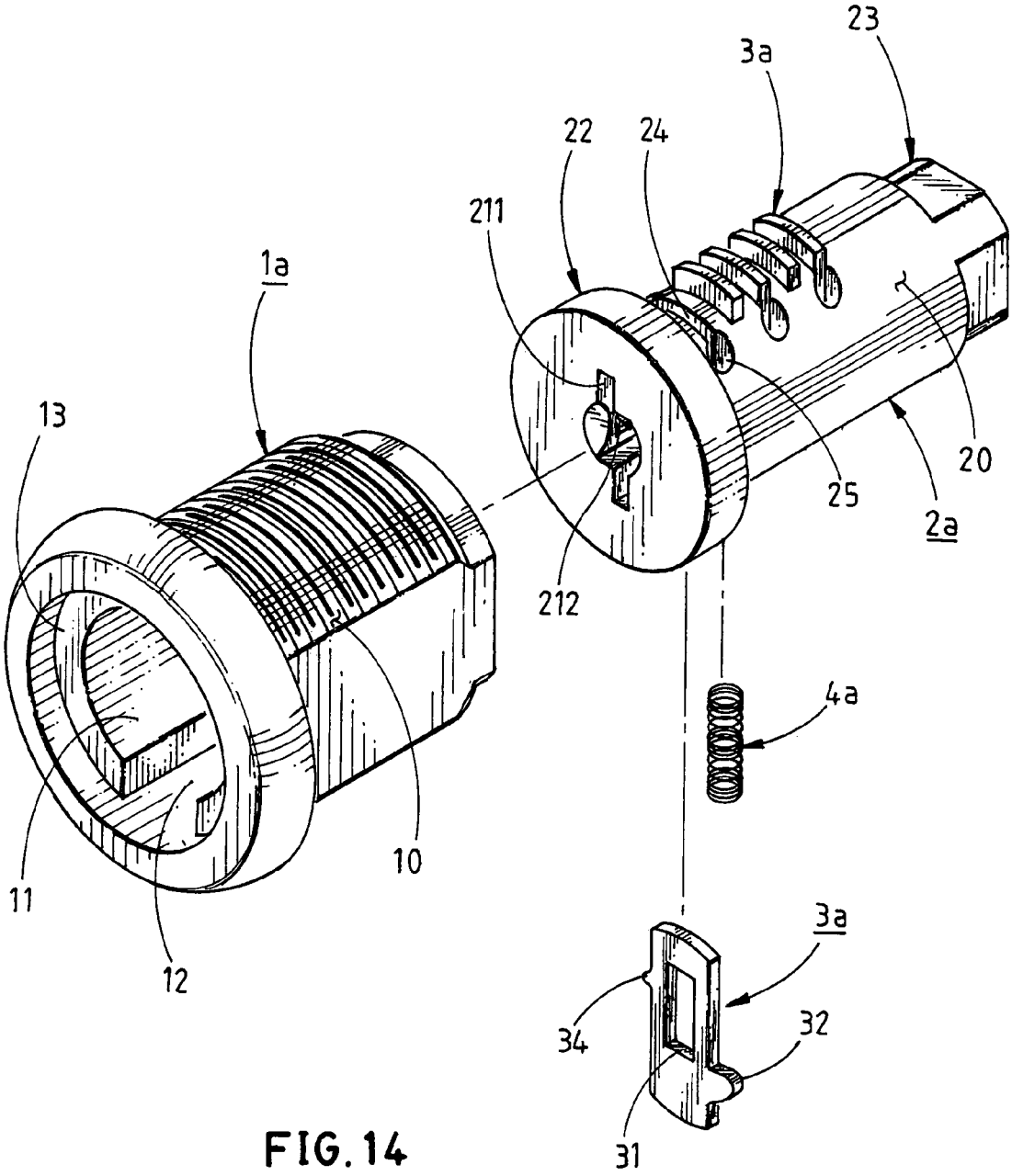
FIG. 14 PRIOR ART
FIG. 14 is an exploded drawing of the conventional wafer-type tumbler.
Figure 15:
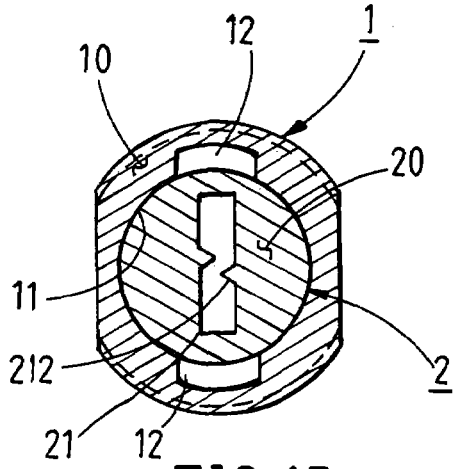
FIG. 15 PRIOR ART
FIG. 15 is a cross-sectional drawing of the conventional wafer-type tumbler when the wafers are not installed.
Figure 16:
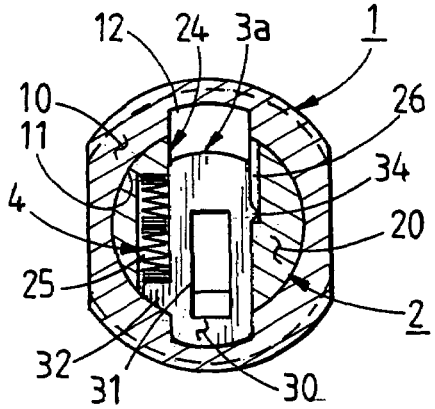
FIG. 16 PRIOR ART
FIG. 16 is a cross-sectional drawing of the conventional wafer-type tumbler wherein a wafer and it spring are disposed.
Figure 17:
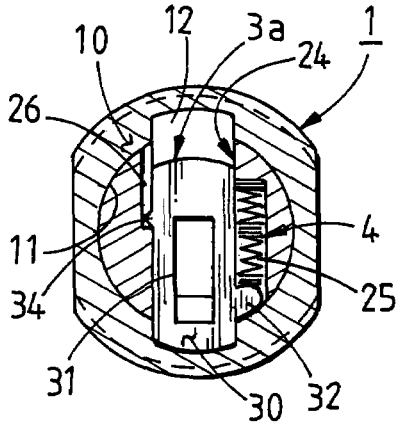
FIG. 17 PRIOR ART
FIG. 17 is a cross-sectional drawing, as viewed from a perspective in FIG. 16, to show the adjacent wafer and its spring.
Figure 18:
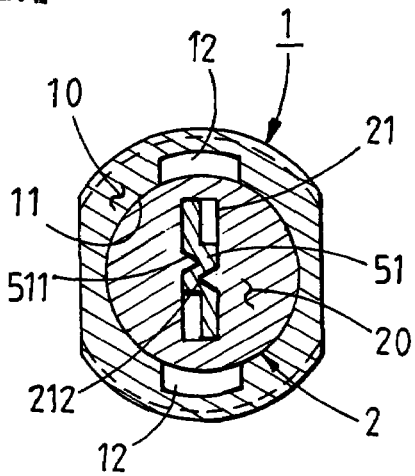
FIG. 18 PRIOR ART
FIG. 18 is a cross-sectional view of the conventional wafer-type tumbler when the serrated blade of the key is inserted.
Figure 20:
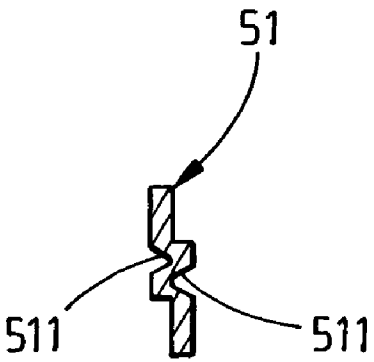
FIG. 20 PRIOR ART
FIG. 20 is a cross-sectional view of the serrated blade of the key in the conventional wafer-type tumbler.
Figure 19:
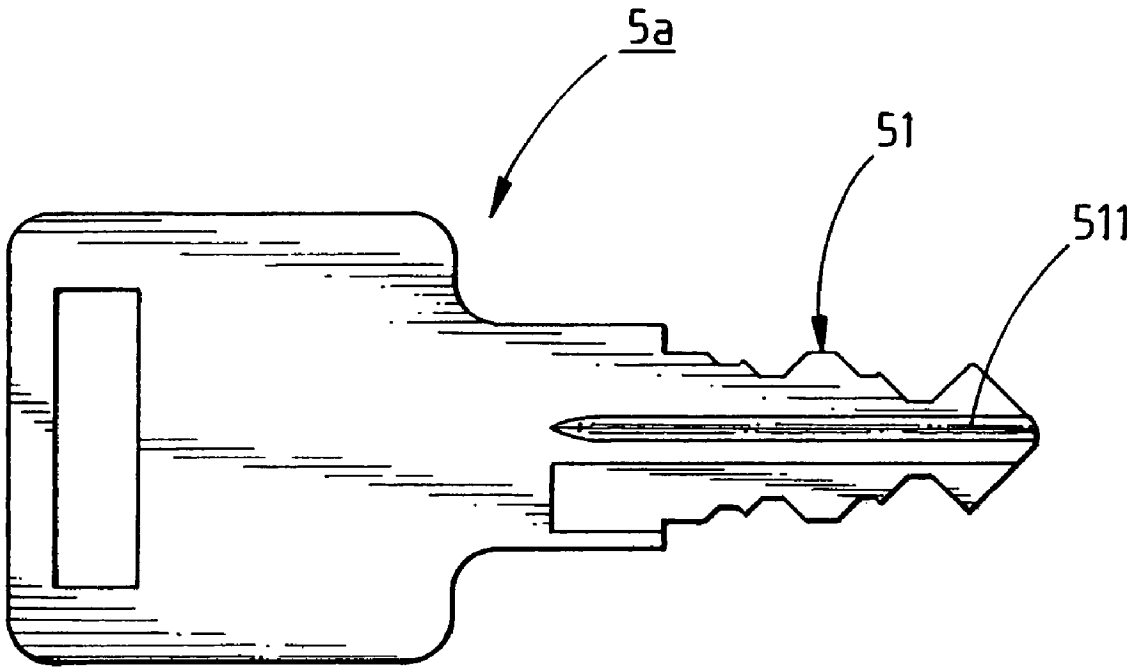
FIG. 19 PRIOR ART
FIG. 19 is an orthographic drawing of the conventional wafer-type tumbler key.

Furthermore, since the wafers 3 of the wafer-type tumbler of the invention herein do not require mounting in rectangular through-holes 24 (as depicted in FIG. 14), said wafers 3 can be fixed on said shaft 20 securely, as shown in FIG. 1, by a window 31 formed in the center of each wafer body 30 along with a spring tab 32 at one side thereof, and there is no need to dispose any locating tab thereon.

Figure 8:
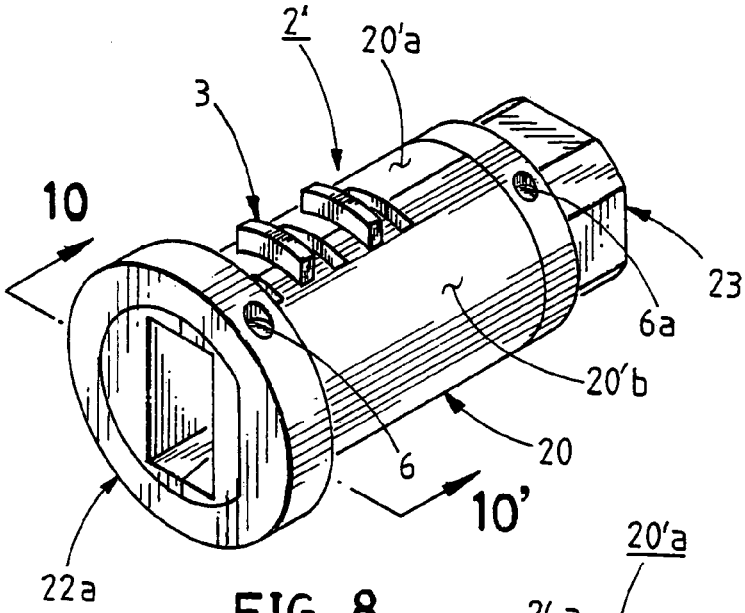
FIG. 8 is an isometric drawing of the preferred embodiment of the cylinder in the present invention.
Figure 9:
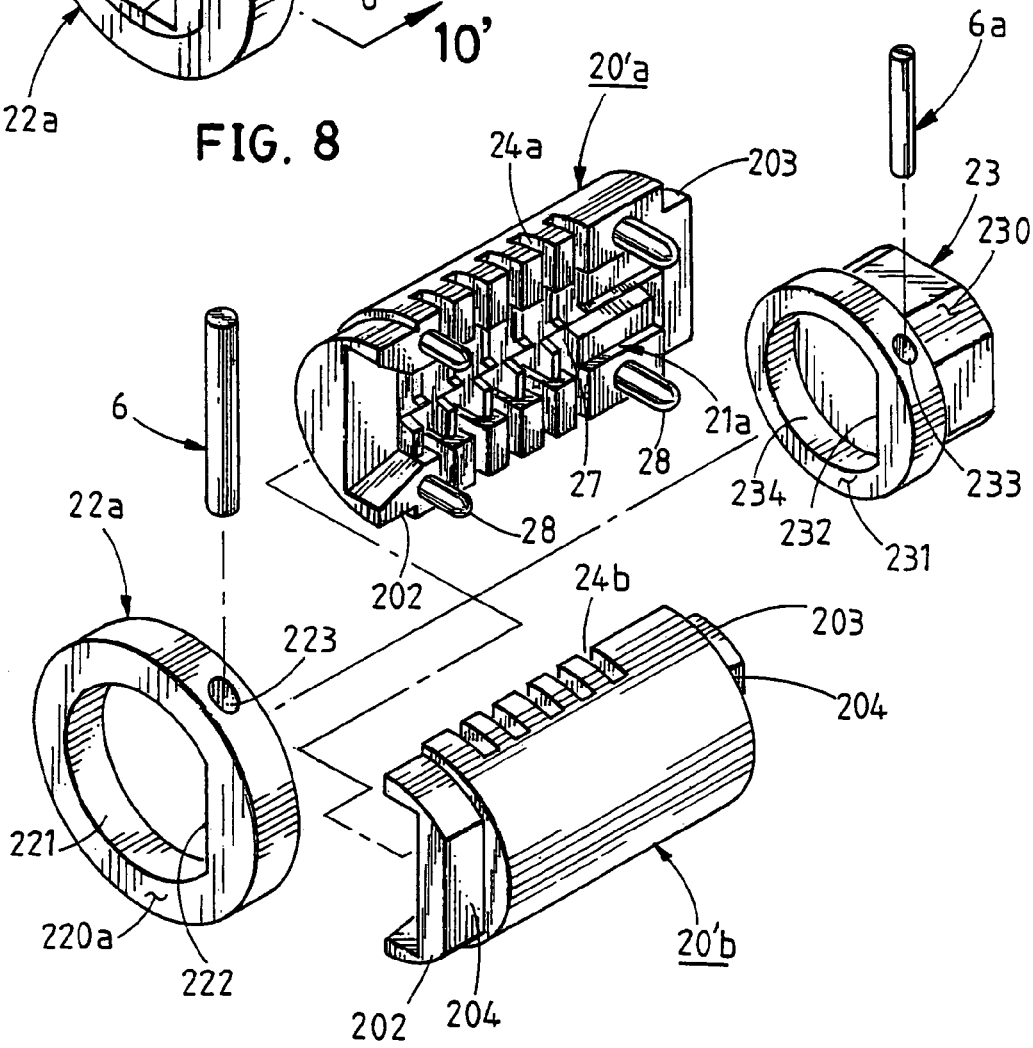
FIG. 9 is an exploded drawing of the preferred embodiment of the cylinder in the present invention.
Figure 10:
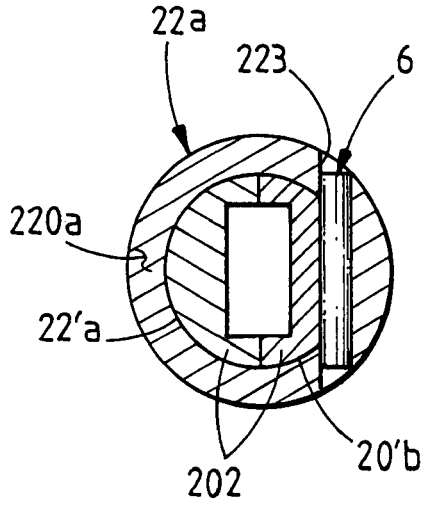
FIG. 10 is a cross-sectional drawing of the invention herein, as viewed from the perspective of line 10~10' in FIG. 8.

Referring to FIGS. 8 and 9, these two figures are isometric and exploded drawings of the preferred embodiment of a cylinder 2' of the present invention. A shaft 20 on the cylinder 2' consists of a first and a second semicircular columnar body 20'*a* and 20'*b* (both of identical shape and dimension) that are conjoined into an integral unity; furthermore, respectively disposed at the front and rear ends of each semicircular columnar body 20'*a* and 20'*b* is a semicircular tenon 202 and 203 which is respectively fitted onto a sleeve ring 22*a* and a drive section 23 to constitute a cylinder 2', as indicated in FIG. 8. The said semicircular tenons 202 at the front ends of said semicircular columnar body 20'*a* and 20'*b* are correspondingly coupled to form a complete tenon, and the said semicircular tenons 203 at the rear ends thereof are correspondingly coupled to form a complete tenon. To enable the precise placement of the sleeve ring 22*a* and the drive section 23 onto the front and rear ends of the integrated semicircular columnar bodies 20'*a* and 20'*b*, as well as to prevent dislodging and comparative rotation, the sleeve ring 22*a* has an inner hole 221 in a ring body 220*a*, which is a D-shaped hole with a minimum of one secant planar edge 222 along one lateral wall, and furthermore, an opening 223 through one side of the ring body 220*a*, wherein the center of said opening 223 is aligned and parallel with said secant planar edge 222; a facet 204 is disposed correspondingly along the outer extent of the semicircular tenon 202 of either the first or the second semicircular columnar body 20'*a* or 20'*b*. As such, the complete tenon that is coupled by means of said semicircular tenons 202 at the front ends of said semicircular columnar body 20'*a* and 20'*b* is installed with the sleeve ring 22*a*, and then a drill is used, through the opening 223, to pierce into the front semicircular tenon 202 having said facet 204 thereof, thereby enabling the insertion of a pin 6 for securing and fixing, as depicted in FIG. 10.

Additionally, the drive section 23, along the inner end of its square or rectangular rod body 230, has an extended sleeve 231 so as to enable the conjoinment with the complete tenon coupled by means of the semicircular tenons 203 at the rear ends of said semicircular columnar body 20'*a* and 20'*b*.

The extended sleeve 231 has disposed a D-shaped cavity 234 having a minimum of one secant planar edge 232 along the inner wall at one side thereof such that an aperture 233 is formed at one side of the extended sleeve 231, of which the center is aligned and parallel with said secant planar edge 232; similarly a facet 204 is correspondingly disposed along the outer extent of the semicircular tenon 203 at the rear end of either the first or the second semicircular columnar body 20'*a* or 20'*b*. As such, the semicircular tenons 203 are assembled into a complete tenon, which is installed with said extended sleeve 231, and in common with the depiction shown in FIG. 10 as well as previous arrangement, a pin 6*a* illustrated in FIG. 9 is fixed with said extended sleeve.

As for the molding process of said first and second semicircular columnar bodies 20'*a* and 20'*b* with identical shape and dimension, the structural and installation arrangement of the corresponding half-keyways 21*a*, 21*b* and the rectangular notches 27, the integration of more than one pair of posts 28 and holes 29, as well as the arrangement of wafers 3 and their springs 4, are the same with the first and second semicircular columnar body 20*a*, 20*b* of the cylinder 2 in the first embodiment of the invention herein; therefore, it shall not be further elaborated. Furthermore, the semicircular tenons 202 and 203 disposed on the two ends of the first and second semicircular columnar bodies 20'*a* and 20'*b*, in addition to the shape of semicircle, they may also be shaped as semi-square, semi-rectangular, semi-hexagonal or semi-polygonal tenons, or even as semi-oval or semi-oblate tenons; moreover, the shape of the inner hole 221 in the ring body 220*a* of the sleeve ring 22*a* accords with that of the D-shaped cavity 234 in the extended sleeve 231 on the drive section 23; at the same time, the shape of the rod body 230 on said drive section 23 may also be disposed as threaded, circular, oblate, tubular or other shaped rod body (not shown in the drawings.)

Figure 11:
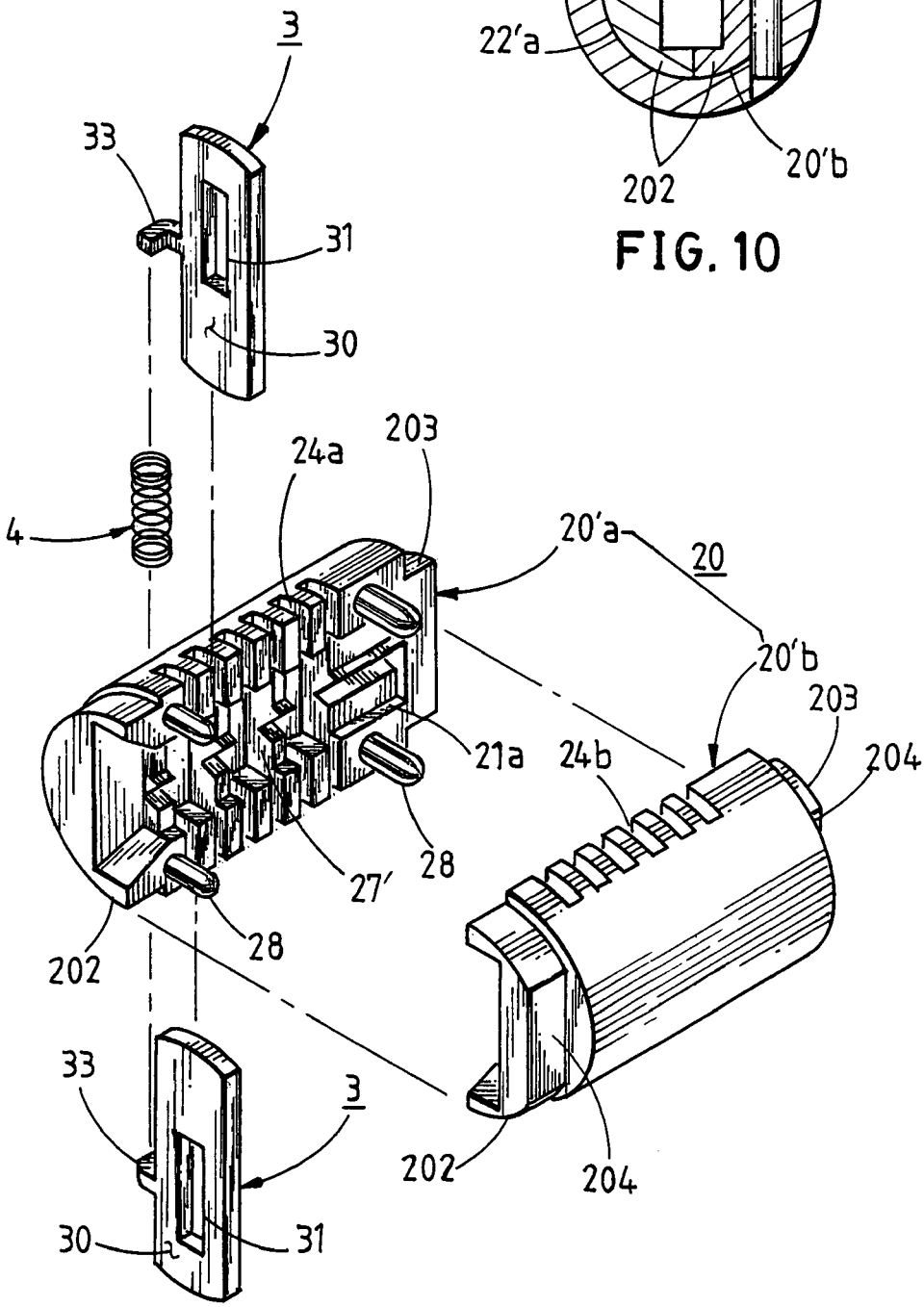
FIG. 11 is an exploded drawing of another preferred embodiment of the cylinder with wafers and a spring.
Figure 12:
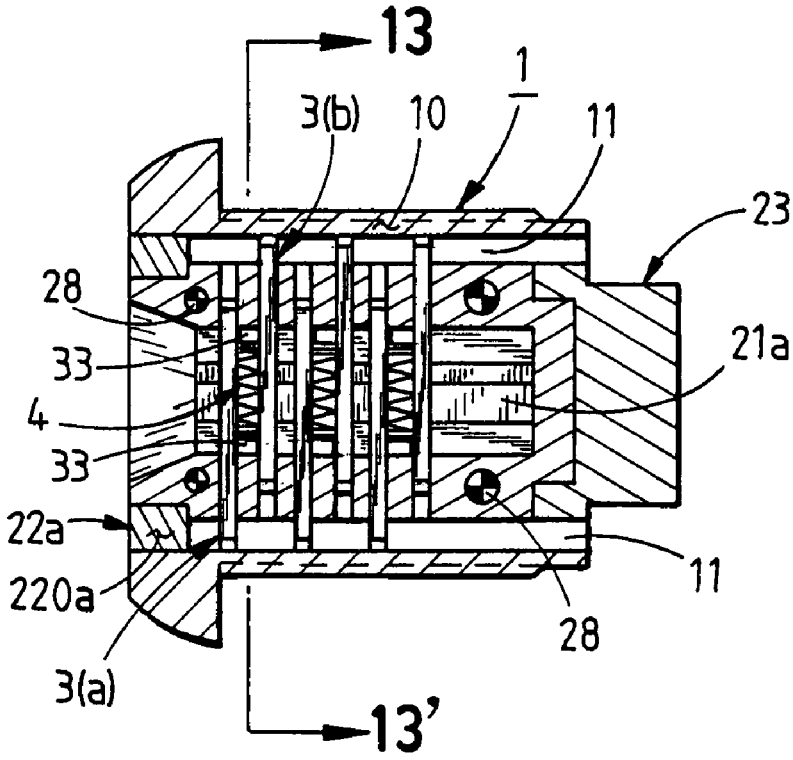
FIG. 12 is a vertically sectional view of the cylinder as viewed from the perspective in FIG. 11.
Figure 13:
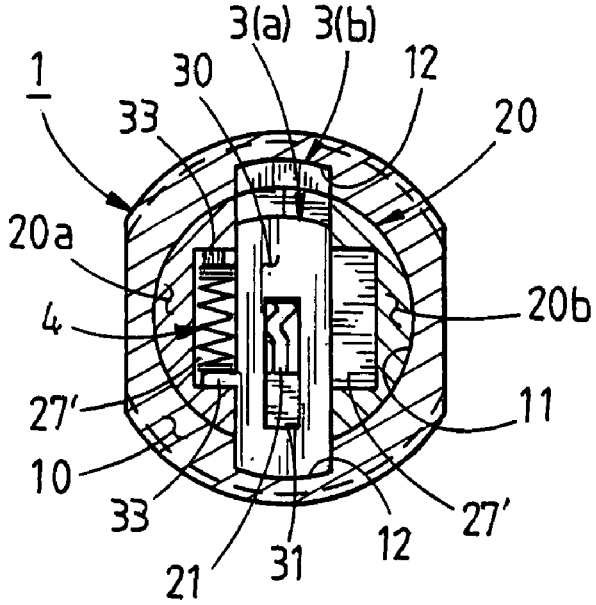
FIG. 13 is a cross-sectional drawing of the invention herein, as viewed from the perspective of line 13~13' in FIG. 12.

FIG. 11 is an exploded drawing of another preferred embodiment of the shaft 20 of the cylinder 2' in the invention herein with wafers 3 and a spring 4. Said shaft 20 also consists of a first and second semicircular columnar body 20'*a* and 20'*b* with identical shape and dimension, which are conjoined into an integral unity, and the preferred embodiment of the semicircular columnar bodies 20'*a* and 20'*b*, between every two rightward U-shaped slots 24*a* or every two leftward U-shaped slots 24*b* disposed in the inner lateral surfaces thereof, is modified by disposing a relatively wider rectangular notch 27'; meanwhile, each wafer 3 is modified by disposing a horizontal L-shaped tab 33 at one side of its wafer body 30. As such, between every pair of (or every two) correspondingly rightward U-shaped slots 24*a* or leftward U-shaped slots 24*b* of each semicircular columnar body 20'*a* and 20'*b* is installed a wafer 3 respectively, and only one spring 4 is positioned in each relatively wider rectangular notch 27', wherein said spring 4 is served as a shared spring for every two wafers 3*a* and 3*b*, as shown in FIGS. 12 and 13. This embodiment of the shaft 20 of the cylinder 2' can similarly be utilized in the preceding embodiment of the shaft 20 of the cylinder 2.

The invention claimed is:

1. A wafer-type tumbler cylinder comprising a sleeve, a cylinder, a plurality of wafers, and a plurality of springs, further including:

a shaft of said cylinder having a first and a second semicircular columnar body;

said first semicircular columnar body having:

a flange disposed at the front end thereof, a drive section disposed at the rear end thereof, one or more rightward U-shaped slots on the inner lateral surface thereof, one or more pairs of posts disposed at the front and rear ends of the inner lateral surface thereof, and a half-keyway disposed in the center of the inner lateral surface thereof;

said second semicircular columnar body having:

one or more leftward U-shaped slots on the inner lateral surface thereof, which correspond to said rightward U-shaped slots of said first semicircular columnar body, one or more pairs of holes disposed at the front and rear ends of the inner lateral surface thereof, which correspond to said posts of said first semicircular columnar body, and a half-keyway formed in the center of the inner lateral surface thereof and in the corresponding position to said half-keyway of said first semicircular columnar body;

each of said wafers and said springs being pivotally fixed in each of said rightward U-shaped slots, then said second semicircular columnar body being inserted into a transversely U-shaped indentation between said flange and said drive section of said first semicircular columnar body, so that each of said posts of said first semicircular columnar body respectively inserted into said holes of said second semicircular columnar body for the assembly of said shaft of said cylinder;

wherein a relatively wider rectangular notch is disposed between every two rightward U-shaped slots or every two leftward U-shaped slots, which are respectively installed with a wafer, and as such, only one spring is positioned in said relatively wider rectangular notch, thereby serving as a shared spring for every two wafers.

2. The wafer-type tumbler cylinder as in claim 1, wherein each said wafer further comprises a horizontal L-shaped tab at one side thereof.

3. A wafer-type tumbler cylinder comprising: a sleeve, a cylinder, a plurality of wafers and a plurality of springs;

said cylinder including a sleeve ring, a first semicircular columnar body, a second semicircular columnar body and a drive section;

said first semicircular columnar body comprising:

one or more rightward U-shaped slots on the inner lateral surface thereof, one or more pairs of posts respectively disposed at the front and rear ends of the inner lateral side thereof, and a half-keyway disposed along the center of the inner lateral side thereof;

said second semicircular columnar body comprising:

one or more leftward U-shaped slots on the inner lateral surface thereof, corresponding to said rightward U-shaped slots of said first semicircular columnar body, one or more pairs of holes disposed at the front and rear ends of the inner lateral surface thereof, corresponding to the positions of said posts disposed on said first semicircular columnar body, and a half-keyway matching with said half-keyway in said first semicircular columnar body, disposed along the center of the inner lateral side thereof;

each said wafer and said spring, first fixed in each of said rightward U-shaped slots on said first semicircular columnar body, then said second semicircular columnar body being inserted into said first semicircular columnar body such that each of said posts respectively inserted into said holes to integrate into said cylinder;

wherein two semicircular tenons at the front and rear ends of said first semicircular columnar body are correspondingly combined with the other two semicircular tenons at the front and rear ends of said second semicircular columnar body, following which said sleeve ring and said drive section are assembled therewith;

wherein a relatively wider rectangular notch is disposed between every two rightward U-shaped slots or every two leftward U-shaped slots, which are respectively installed with a wafer, and as such, only one spring is positioned in said relatively wider rectangular notch, thereby serving as a shared spring for every two wafers.

4. The wafer-type tumbler cylinder of claim 3, wherein said sleeve ring further comprises:

an inner hole, with a minimum of one secant planar edge along one lateral wall to form a D-shaped hole, and an opening at one side thereof, the center of which aligned and parallel with said secant planar edge;

said drive section having an extended sleeve along the inner end of a square or rectangular rod body thereof, said extended sleeve having a D-shaped cavity, with a minimum of one secant planar edge along the inner wall thereof, and an aperture at one side of said extended sleeve, the center of which aligned and parallel with said secant planar edge;

wherein said two semicircular tenons of said first or second semicircular columnar body have a facet respectively disposed at the outer extent thereof.

* * * * *